United States Patent [19]

Nemeskal

[11] Patent Number: 5,048,818

[45] Date of Patent: Sep. 17, 1991

[54] APPARATUS FOR SUBDIVIDING A SHINGLED STREAM OF PAPER SHEETS

[75] Inventor: Günther Nemeskal, Vienna, Austria

[73] Assignee: Strohal Gesellschaft M.B.H., Vienna, Austria

[21] Appl. No.: 574,354

[22] Filed: Aug. 28, 1990

[30] Foreign Application Priority Data

Aug. 31, 1989 [AT] Austria ..... A2059/89

[51] Int. Cl.[5] ..... B65H 29/00

[52] U.S. Cl. ..... 271/283; 271/197; 271/216; 198/438

[58] Field of Search ..... 198/428, 438, 427; 271/282, 283, 284, 285, 151, 197, 216, 276

[56] References Cited

U.S. PATENT DOCUMENTS 2,941,653 6/1960 Kriemelmeyer ..... 198/438

3,659,840 5/1972 Ruck ..... 271/197 X 3,674,257 7/1972 Neeb et al. ..... 271/284

4,266,654 5/1981 Achelpohl et al. ..... 198/428 X

*Primary Examiner*—Joseph E. Valenza

*Assistant Examiner*—Keith L. Dixon

*Attorney, Agent, or Firm*—Herbert Dubno

[57] ABSTRACT

An apparatus for splitting a shingled stream of paired coextensive sheets into two partial stream is advanced below an upper conveyor to which suction can be applied and which displaces the sheets at an acute angle to the main path defined by the lower conveyor. The upper conveyor engages only the upper sheet of each pair and shifts it laterally to deposit it on the lower conveyor in a shingled partial stream parallel to the partial stream which remains of the lower sheets after the upper sheets of each pair has been laterally drawn away.

12 Claims, 3 Drawing Sheets

APPARATUS FOR SUBDIVIDING A SHINGLED STREAM OF PAPER SHEETS

FIELD OF THE INVENTION

My present invention relates to an apparatus for the subdivision of a shingled stream of paper sheets in which the overlapping paper sheets, also referred to as shingles, can be provided in pairs and the apparatus can separate one member of each pair from the other to thereby transform the main stream of shingled sheets into two partial streams thereof, thereby uncovering a lower sheet of the pair.

BACKGROUND OF THE INVENTION

In the printing field it is common to form a shingled stream of paper sheets, for example, after a large sheet of paper is printed in, for example, an offset printing machine. This large sheet can be folded and cut to provide so-called cut sheets which can be advanced in a shingled pattern, i.e. with each sheet overlapping and overlapped by adjacent sheets in the advance of the stream.

The cut sheets may be provided in such manner that two folded cut sheets are derived from each large sheet and two cut sheets can then be oriented so that an upper sheet with its fold opposite the lower cut sheet can be coextensive with it, i.e. can completely cover the lower sheet of the pair so that the borders of the two cut sheets of the pair coincide exactly.

Just as individual cut sheets can be shingled, it is possible that a main stream of cut sheets in a shingled pattern may have pairs of such cut sheets disposed in the shingled array so that each pair, in turn, overlaps and is in turn overlapped by adjacent pairs of sheets.

Where the pairs of cut sheets are shingled and an upper shingle overlies a lower shingle of the pair, it is desirable to separate the upper sheets from the lower sheets. In the past this picking or culling of the upper sheets from the lower sheets to establish, for example, two partial streams of shingled sheets has been done by hand at relatively high personnel cost.

In Swiss patent 655,489, it is taught to separate or split a sheet stream of shingled sheets but this requires that the upper and lower sheets of each pair of shingles be offset from one another so that they can be engaged by different forms. The technique of this patent is not suitable where the shingles or cut sheets are provided in pairs and, within each pair, are coextensive with one another.

Swiss patent 663,604 describes a deflecting device for a sheet stream of, for example, brochures, signatures or sheets (shingles). A plurality of conveyor paths are provided and connect to one another. A partial stretch form, a branch and is swingable so that the travel direction can be changed for the various items advanced in the main stream. This can allow a diversion of the stream of paper articles through 180°.

In general, therefore, a system which permits splitting of a main stream of shingled sheets in which the shingled sheets are provided in coextensive pairs has not been available for automatic and low-cost separation of the sheets of the pair and the formation of two shingled partial streams of the sheets as is frequently desirable.

OBJECTS OF THE INVENTION

It is, therefore, the principal object of the present invention to provide an apparatus for splitting a main stream of shingled sheets which can automatically separate the sheets where they are provided in coextensive pairs.

Another object of the invention is to provide an apparatus which can carry out splitting of a main stream of shingled pairs of sheets whereby drawbacks of earlier systems are avoided.

SUMMARY OF THE INVENTION

These objects and others which will become apparent hereafter are attained in accordance with the present invention in an apparatus which comprises:

a lower conveyor belt carrying the main shingled stream of coextensive pairs of paper sheets overlapping and overlapped by adjacent coextensive pairs and advancing the main shingled stream of coextensive pairs of paper sheets in a transport direction;

a perforated upper conveyor belt juxtaposed with upper surfaces of upper paper sheets of successive coextensive pairs of paper sheets of the main shingled stream and displaceable in a direction inclined away from the main shingled stream at an acute angle to the transport direction; and means for applying suction to perforations of the upper conveyor belt for serially drawing each upper paper sheet against the upper conveyor belt whereby the displacement of the upper conveyor belt entrains the upper paper sheets in succession laterally of the main stream into one shingled partial stream while uncovering each lower paper sheet of a respective pair so that the lower paper sheets continue in the transport direction in another shingled partial stream.

According to the invention, therefore, the main stream of paired shingles is displaced upon a first conveyor belt, referred to herein as the lower conveyor belt, while a second or upper conveyor belt is brought close to the upper surface of the paired shingles of the main stream, is perforated and is subjected to suction so that the upper shingle of each pair, as the shingled pairs are advanced by the lower conveyor in a transport direction, is carried laterally at an acute angle to this direction by the second conveyor belt.

When the superimposed shingles on the lower conveyor belt thus reach the location at which the upper conveyor belt begins, the upper shingle is drawn by suction against the upper conveyor belt and laterally drawn out of the main stream so that the two shingles of the pair are separated and the lower shingle continues along its original path in one partial stream while the upper sheet is deposited in a second partial stream parallel to the first.

Preferably the distance between the two conveyor belts is adjustable so that the bottom of the upper conveyor belt is positioned only slightly above the height of the superimposed shingles, thereby allowing the uppermost member of the pair to be readily engaged and easily drawn by suction while permitting the shingled stream to pass readily beneath the upper conveyor belt.

It has been found to be advantageous, moreover, to form the lower conveyor belt so that it is at least twice as wide as the upper conveyor belt and to position the upper conveyor belt so that it lies wholly within the width of the lower conveyor belt. In this construction, the upper shingles or sheets after they have been laterally transferred, can again be deposited on the lower conveyor belt so that both streams can then be advanced on the latter and separately stacked.

In this latter case it has been found to be advantageous to form the lower transport belt in the region where it passes below the beginning of the upper conveyor belt with perforations overlying the suction box so that the lower shingles or sheets of the pairs can be retained by suction against the lower belt and will not be readily shifted when the upper shingle or sheet is drawn laterally away from the main stream. The upper sheets, of course, are not drawn by suction against the lower belt since they are separated by the lower sheets therefrom and thus are readily laterally shifted by the upper belt.

During and after the lateral shifting, the upper sheets are deposited directly upon the lower transport belt which need normally not have any perforations or suction in the region in which they are deposited s that lateral movement is not hindered. If perforations are to be provided to hold the upper sheets against the lower belt after the lateral shift, the perforations should only be supplied with suction at locations downstream of the location at which the upper sheets are deposited.

It has been found to be advantageous, moreover, to provide means for adjusting the speed of the upper conveyor belt relative to the lower conveyor belt. This speed should be selected to obtain the desired degree of overlap in the partial stream formed by the upper sheets. The greater degree of overlap in this shingled partial stream, the more rapidly is the upper conveyor belt required to move.

BRIEF DESCRIPTION OF THE DRAWING

The above and other objects, features and advantages of the present invention will become more readily apparent from the following description, reference being made to the accompanying drawing in which:.

SPECIFIC DESCRIPTION

Figure 1:
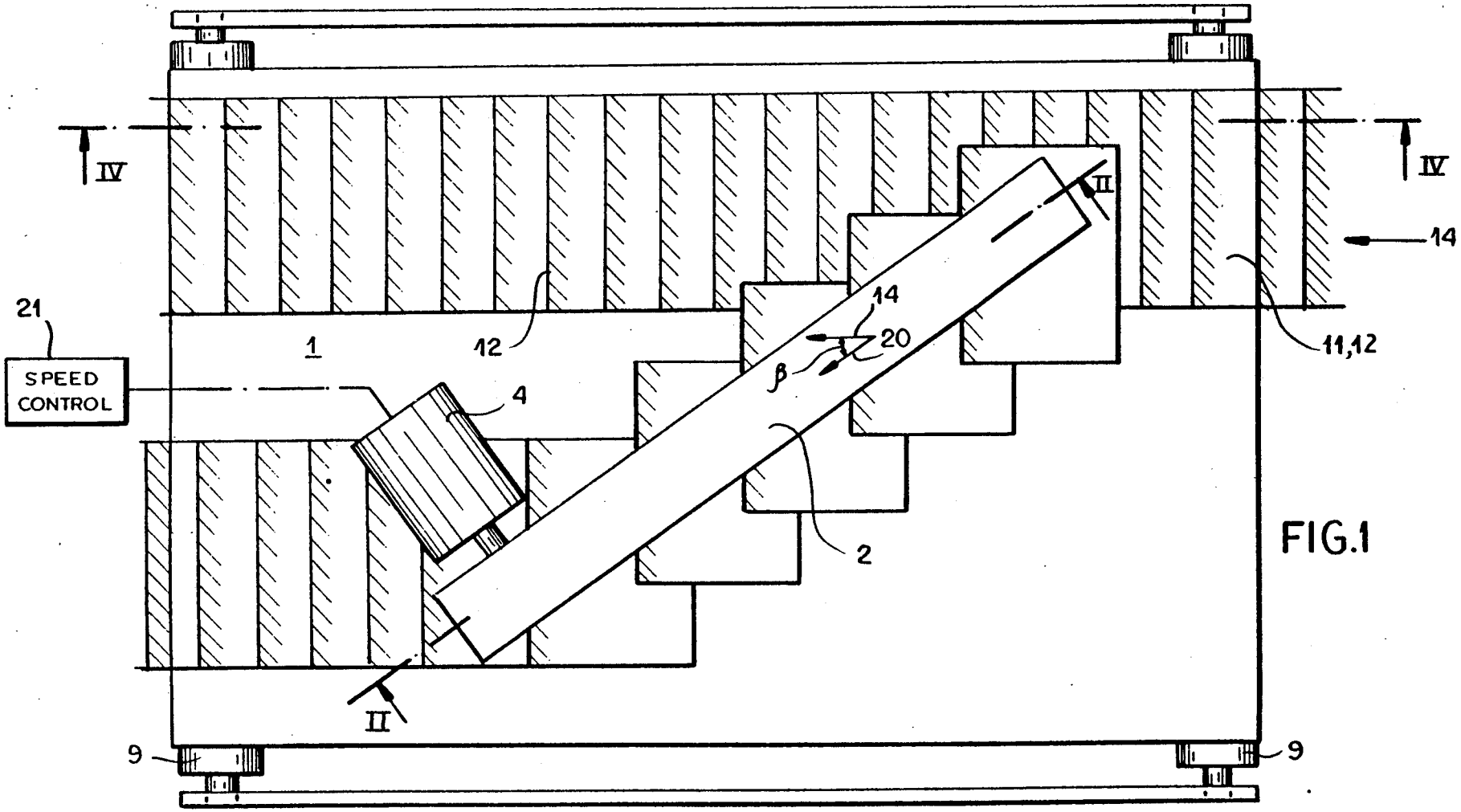
FIG. 1 is a diagrammatic plan view illustrating the principles of the invention.

As can be readily seen from FIG. 1, the apparatus of the invention generally comprises a lower conveyor belt 1 and an upper conveyor belt 2, the transport directions of the two conveyor belts defining an acute angle between them.

For example, the main direction can be represented by the arrows 14 in the drawing and the direction of the upper conveyor belt by the arrow 20, so that the acute angle is represented by the angle $\beta$ in FIG. 1.

Figure 2:
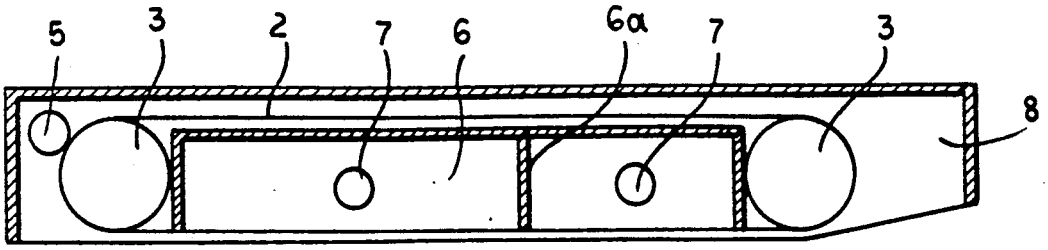
FIG. 2 is a cross sectional view taken along the line II—II of FIG. 1.
Figure 3:
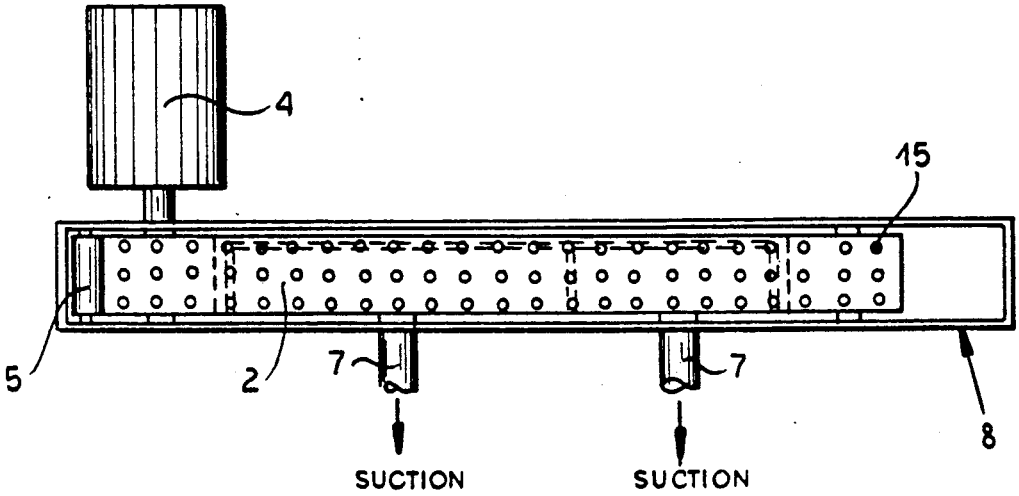
FIG. 3 is a bottom plan view of the upper conveyor belt.

As can be seen from FIGS. 2 and 3, the upper conveyor belt 2 is perforated at 15 and cooperates with suction boxes 6 separated from one another by a partition 6*a*.

The conveyor 2 passes around guide rollers 3 in a housing 8 and is driven by a potentiometer-controlled drive motor 4. In FIG. 1, the speed control for this belt has been represented at 21.

To prevent slip of the conveyor belt 2, the pressing roller 5 is provided and urges the belt 2 against the driven guide roller 3. In the space enclosed by the upper belt 2, divided suction box 6 is provided and the respective sections of this suction box can have respective suction openings 7, connected to a suction source.

Figure 4:
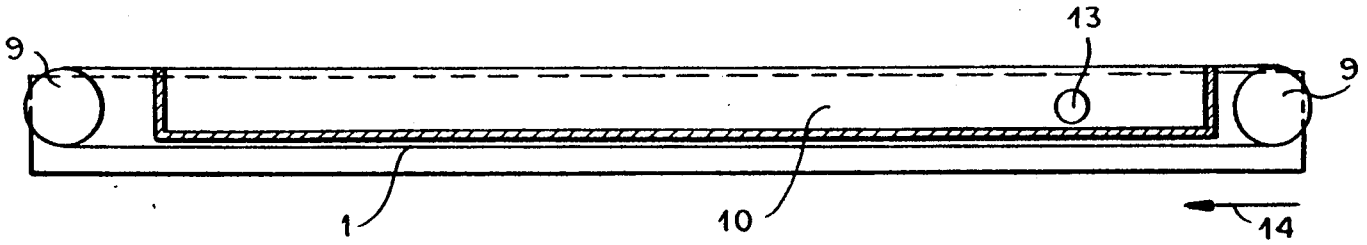
FIG. 4 is a section taken along line IV—IV of FIG. 1 through the lower conveyor belt.
Figure 5:
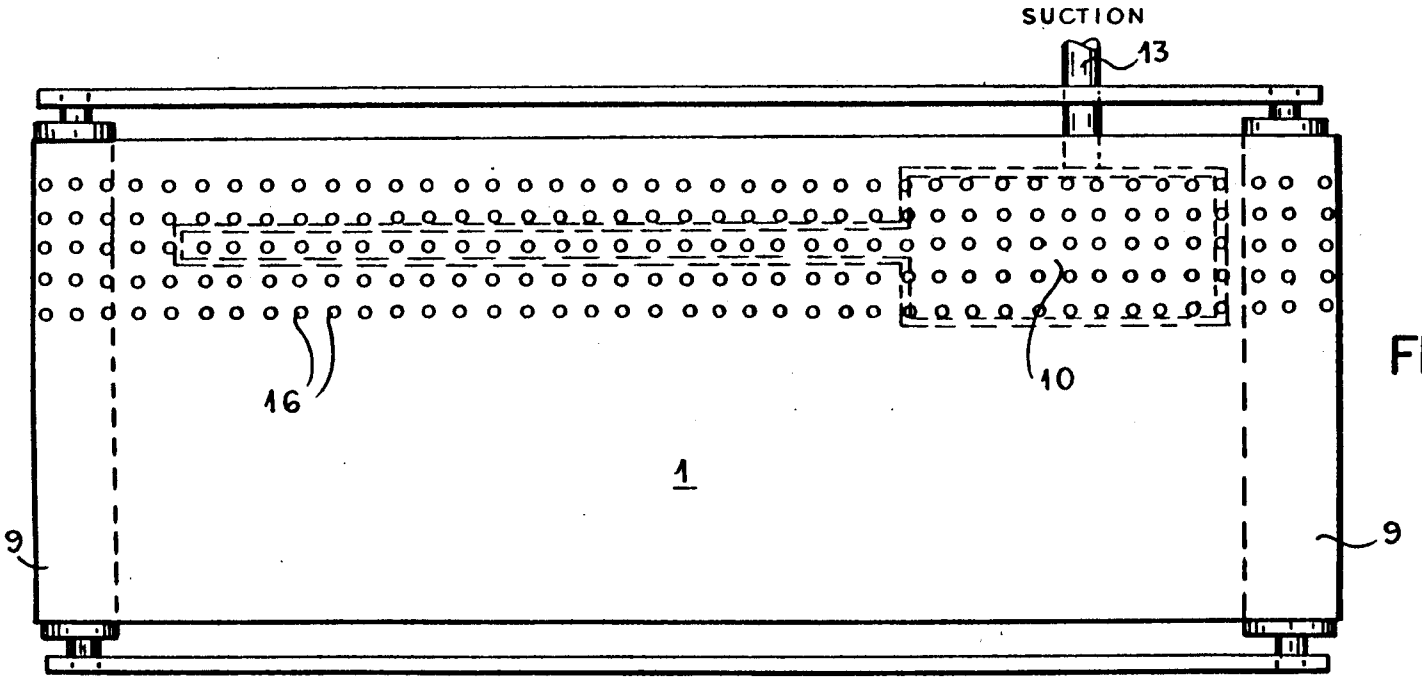
FIG. 5 is a plan view of the lower conveyor belt without the shingled streams thereon.

As can be seen in FIGS. 4 and 5, the lower transport belt 1 is provided with perforations 16 in the region in which the main shingled stream is received by this belt. The belt 1 passes over guide rollers 9 form which a stacking arm, not shown, is driven. In the space enclosed by the transport belt 1, a suction box 10 is provided. This suction box is equipped with a suction opening connected to a suction source.

The shingled stream of double shingles or paired sheets lying upon the lower conveyor belt is advanced in the direction 14. The lower sheet of each pair is represented at 12, while the upper sheet is shown at 11. As the pairs of sheets reach the beginning of the conveyor 2, i.e. the upper right portion thereof in FIG. 1, the suction applied to this conveyor by the suction box 6 causes the upper conveyor belt to seize, lift and laterally transport the upper sheet 11 away form the lower sheet 12, uncovering the latter.

The lower sheets 12, because of the suction applied thereto form the suction box 10, remain in place on the lower transport belt and are carried to the left in one partial stream. At the lower left end of the upper transport belt as seen in FIG. 1, the upper sheets 11 are disposed in a suction partial stream on the upper belt 1, laterally offset from the first.

Figure 6:
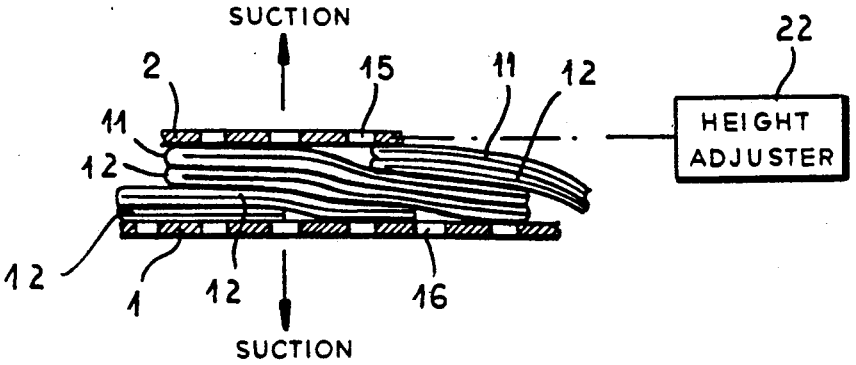
FIG. 6 is a diagram illustrating the relationship between the conveyor belt and the shingled pairs of sheets.

The principle of this operation is shown diagrammatically in FIG. 6 from which it will be apparent that the suction applied through the lower belt 1 retains only the lower sheets against the lower belt while the upper sheets are drawn by suction against the upper belt 2 and carried transversely to the plane of the paper in FIG. 6. The height adjuster for the upper belt 2 has been represented at 22 in FIG. 6.

I claim:

1. An apparatus for separating a main shingled stream of coextensive pairs of paper sheets overlapping and overlapped by adjacent coextensive pairs into two partial shingled streams, comprising:

a lower conveyor belt carrying said main shingled stream of coextensive pairs of paper sheets overlapping and overlapped by adjacent coextensive pairs and advancing said main shingled stream of coextensive pairs of paper sheets in a transport direction;

a perforated upper conveyor belt juxtaposed with upper surfaces of upper paper sheets of successive coextensive pairs of paper sheets of said main shingled stream and displaceable in a direction inclined away from said main shingled stream at an acute angle to said transport direction; and means for applying suction to perforations of said upper conveyor belt for serially drawing each upper paper sheet against said upper conveyor belt whereby the displacement of said upper conveyor belt entrains said upper paper sheets in succession laterally of said main stream into one shingled partial stream while uncovering each lower paper sheet of a respective pair so that said lower paper sheets continue in said transport direction in another shingled partial stream.

2. The apparatus defined in claim 1 wherein said conveyor belts are dimensioned so that said upper conveyor belt deposits said upper paper sheets on said lower conveyor belt in said one partial stream.

3. The apparatus defined in claim 2, further comprising means for adjusting a spacing between said upper and lower conveyor belts.

4. The apparatus defined in claim 1 wherein said lower conveyor belt has a width at least twice a width of said upper conveyor belt and at least a length of said upper conveyor belt subjected to said suction lies within the width of said lower conveyor belt.

5. The apparatus defined in claim 4 wherein a full length of said upper conveyor belt lies within the width of said lower conveyor belt.

6. The apparatus defined in claim 4 wherein said lower conveyor belt is formed with a perforated region of the width of said lower conveyor belt at which said upper conveyor belt initially entrains said upper paper sheets from said main stream, said apparatus further comprising means for applying suction to said perforated region for retaining said lower sheets against said lower conveyor belt and said upper conveyor belt uncovers said lower sheets.

7. The apparatus defined in claim 6, further comprising means for adjusting a speed of one of said conveyor belts relative to the other of said conveyor belts.

8. The apparatus defined in claim 7 wherein a full length of said upper conveyor belt lies within the width of said lower conveyor belt.

9. The apparatus defined in claim 8 wherein said conveyor belts are dimensioned so that said upper conveyor belt deposits said upper paper sheets on said lower conveyor belt in said one partial stream.

10. The apparatus defined in claim 9, further comprising means for adjusting a spacing between said upper and lower conveyor belts.

11. The apparatus defined in claim !0 wherein said lower conveyor belt is only perforated and supplied with suction in said region and is unperforated in a region at which said one partial stream is deposited on said lower conveyor.

12. The apparatus defined in claim 1, further comprising means for adjusting a speed of one of said conveyor belts relative to the other of said conveyor belts.

* * * * *